United States Patent [19]

Frykhult et al.

[11] 4,211,643

[45] Jul. 8, 1980

[54] HYDROCYCLONE SEPARATOR

[75] Inventors: Rune H. Frykhult, Huddinge; Lars-Göran Rundqvist, Tumba, both of Sweden

[73] Assignee: AB Celleco, Tumba, Sweden

[21] Appl. No.: 13,197

[22] Filed: Feb. 16, 1979

[30] Foreign Application Priority Data

Feb. 22, 1978 [SE] Sweden ..... 7802042

[51] Int. Cl.[2] ..... B04C 5/08

[52] U.S. Cl. ..... 209/211; 210/512 R

[58] Field of Search ..... 209/144, 211; 210/512 R, 512 M; 55/274 R, 435, 459 R; 73/49.1, 49.2, 49.3, 40; 340/605; 116/266, 227, 200, 208

[56] References Cited

U.S. PATENT DOCUMENTS

| | | | |
|---|---|---|---|
| Re. 25,099 | 12/1961 | Hoffmann | 210/512 M |
| 2,658,728 | 11/1953 | Evans | 73/40 |
| 3,259,247 | 7/1966 | Stauenger | 209/211 |
| 3,391,787 | 7/1968 | Salomon | 210/512 R |
| 3,861,532 | 1/1975 | Skardal | 209/211 |
| 3,959,123 | 5/1976 | Wikoahlk | 209/211 |
| 4,155,839 | 5/1979 | Seifert et al. | 209/211 |

FOREIGN PATENT DOCUMENTS

| | | | |
|---|---|---|---|
| 341531 | 7/1972 | U.S.S.R. | 209/11 |

*Primary Examiner*—Ralph J. Hill
*Attorney, Agent, or Firm*—Cyrus S. Hapgood

[57] ABSTRACT

A hydrocyclone separator for separating a materials mixture into fractions with an upper covered cylindrical part and a lower concial part, the upper part having a tangential inlet, and an axial outlet on its cover; the lower part having an outlet at its bottom.

A cylindrical shell or mantle surrounds the container to receive leakage. The shell and container form three compartments with individual openings in which are pressure-sensitive or other sensitive indicators to show the presence of leakage.

7 Claims, 2 Drawing Figures

HYDROCYCLONE SEPARATOR

Figure 1:
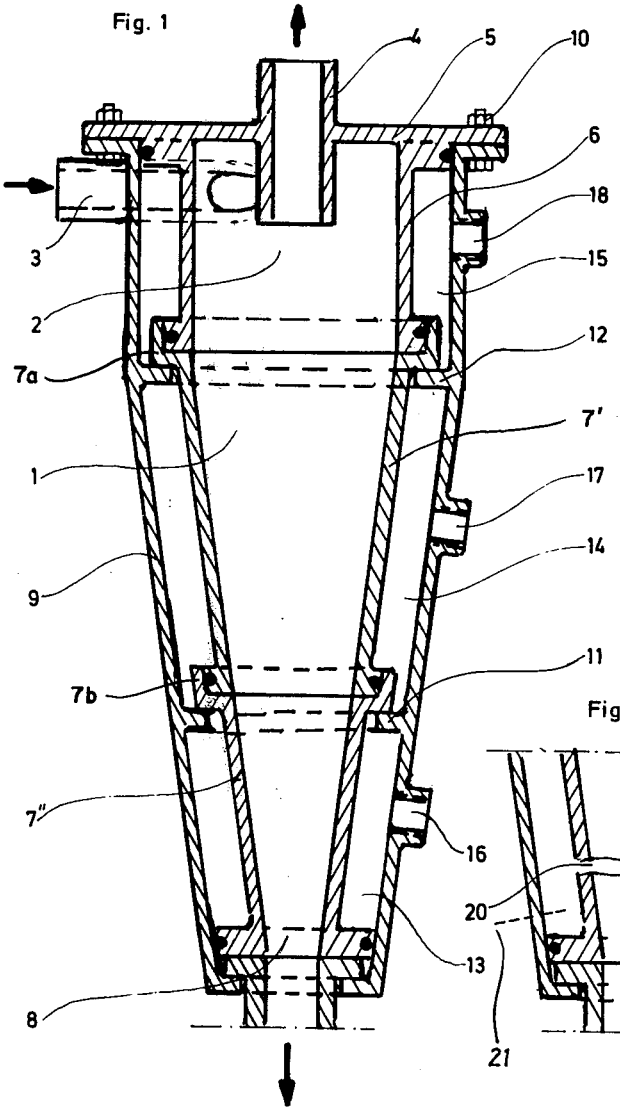

This invention relates to a hydrocyclone separator for the separation of a material mixture into two fractions. More particularly the invention relates to a separation chamber including a circular cylindrical part having at least one tangential inlet for the material mixture feed and having a central first outlet for one of the fractions, and also including a concical part defining a second outlet for the second fraction.

Hydrocyclone separators have many uses, especially in the cellulose industry for the purification of cellulose fiber suspensions. The impurities consist substantially of sand, bark-particles and incompletely digested fibers. These impurities, especially sand particles, act abrasively on the wall of the hydrocyclone, especially in the lower part of the separation chamber, where the particles can make grooves in planes perpendicular to the symmetry axis of the hydrocyclone. After a more or less long period of operation time, such grooves may deepen and actually cut through the hydrocyclone separator. In the pulp and paper industry the process temperatures have increased in certain parts of modern plants. Two reasons for this are that new processes have been introduced and that processes already in use have been carried out in a more "closed" form, i.e., the process water is recirculated to a higher extent than previously. In this way considerable savings have been obtained as to fibers and chemicals and energy. The environmental problems have also diminished.

The higher process temperatures have, however, resulted in problems as to the hydrocyclone separators in the plants, due to the fact that the separators are often made from plastic material. At high temperatures the strength of the plastic materials is considerably reduced, with the result that the hydrocyclone separators wear out more quickly, and eventually leakage occurs. Considering the hundreds of hydrocyclone separators that are used in plants of the pulp and paper industry, leakage is a serious problem, both from a security and an economical point of view. Uncontrolled leakage of a liquid with a temperature of 80°-90° C. can bring about burns on the operators. When any such leakage occurs, the operation must be disrupted and the damaged apparatus must be replaced by new equipment. Such unplanned stoppage is extremely costly.

One object of the present invention is to provide a hydrocyclone separator of the type mentioned, which eliminates the drawbacks mentioned above in a simple and inexpensive way.

According to the invention, a hydrocyclone separator has its separation chamber enclosed by an outer shell, around at least a part of the periphery of the separation chamber, providing a closed space between the separation chamber and the shell; and means is provided for sensing and/or indicating any leakage from the separation chamber to said space. In one preferred embodiment of the invention the outer shell encloses the whole separation chamber.

In one embodiment of the invention, the outer shell is formed at least partly of a transparent material, thus providing means for visual indication of material leaking into the compartment or compartments between the shell and the separation chamber. Thus the operators may inspect the hydrocyclone separators periodically and observe the presence of any material, in the space between the separation chamber and the outer shell.

During a planned operation stop hydrocyclone separators, that show leakage visible through the outer mantle, are replaced. In some cases it may be advantageous to provide at least one opening in the outer shell, through which leaking material is allowed to be discharged. By limiting the throughflow area of such an opening, the discharged flow will primarily act as an indicator of leakage. The opening should be designed in order that it can be easily closed by a suitable plug, or possibly be provided with an externally threaded pipe on which an internally threaded cap may be screwed.

Other objects and advantages of the invention will become apparent as it is described in connected with the accompanying drawing.

In the drawing, FIG. 1 is a longitudinal section view of a hydrocyclone embodying the invention, the section being taken along the axis of symmetry.

Figure 2:
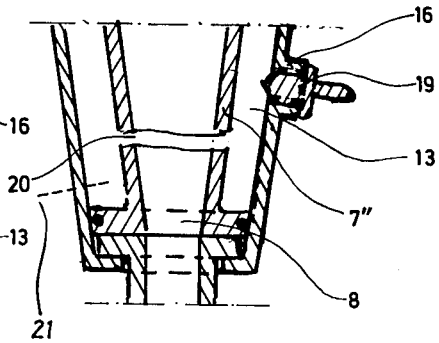

FIG. 2 is a fragmentary section view, partly broken away, of the discharge end of the conical part of the separation chamber of FIG. 1.

Referring to FIG. 1, the hydrocyclone separator is formed of an upper member having a cylindrical side wall 6 enclosing a chamber portion 2 whose upper end is closed by a plane plate-like cap part 5 integral with and extending radially outwardly beyond the top of the side wall 6. Connected with the cylindrical wall 6 adjacent its top is a tangential inlet or pipe 3. An upper discharge pipe 4, formed integrally with the cap part 5 coaxially with the wall 6, extends inwardly and outwardly of the cap part.

Attached to the lower rim of the cylindrical wall 6 is a hollow two part conical formation 7', 7'' which forms the lower portion 1 which together with the upper portion 2 forms the separation chamber of the separator. The lower end of the bottom part 7'' defines a second or bottom outlet 8.

The separation chamber is enclosed by a mantle or outer shell 9 having a shape similar to the walls 6, 7', 7'' and extending from the outlet 8, which it surrounds, to the cap part 5. At its upper end the shell 9 is provided with an integral radial flange which lies flush against the radial extension of the cap part to which it is attached by throughbolts 10.

For constructional reasons the shell 9 is provided with two internal radial flanges 11 and 12 at approximately equally spaced positions along its length. Upon flanges 11 and 12 rest ribs *7a*, *7b*, formed on the upper edges of the walls 7', 7'', respectively, and extending radially outwardly.

The flanges thus divide the space between the shell 9 and walls 7', 7'' into three tight compartments 13, 14 and 15, which are each provided with sealable openings or ports 16, 17 and 18, respectively.

When the hydrocyclone operates, any leaking material is discharged into one or another of the compartments 13, 14 or 15 between the separation chamber and the outer shell. The leakage material will fill the compartment adjacent the leak and will flow out through the opening provided. The operators observe the leakage, note from which opening the material is discharged, and either they put a plug in the opening in question, or, if the sealing between compartments 13, 14 and 15 is not sufficient, plugs are put in all openings 16, 17 and 18. It will be apparent that the unplugged openings 16, 17 and 18 constitute means for maintaining the respective compartments at a lower pressure than that at the outer periphery of the separation chamber when the separator is in operation, whereby each compartment can receive leakage from the separation chamber.

In FIG. 2 opening 16 is shown provided with a plug 19. In this figure a cut 20 on the conical part 7 of the separation chamber is shown.

In FIG. 2 there is also shown a sensing means 21, which can be of a type, that senses pressure, conductivity or another suitable property in any material, leaking into space 13.

In embodiments, where openings 16, 17 and 18 are not provided, leakage material is only discharged into the space between the separation chamber and outer shell 9, where it may be observed visually, for which purpose the shell is at least partly transparent or parts of it at various positions along its height are transparent. Alternatively, where a pressure sensitive means is provided, or where heat or electrical conductivity sensing means, or means for sensing another suitable property of the material, is provided, such sensing means can be observed.

Considering the great number of hydrocyclones usually present in a plant, it might be practical to connect the signal, indicating leakage, from the single apparatus, for instance, to an instrument panel. In this way, means for sensing pressure, conductivity or other means is provided in the space between the separation chamber and the outer mantle in every single hydrocyclone separator. Every means is connected to an electric or a pneumatic line to said instrument panel.

The sensing and indicating means may be conventional and hence their details need not be shown or described.

Many modifications within the scope of the invention will occur to those skilled in the art. Therefore, the invention is not limited to the specific embodiments disclosed.

We claim:

1. A hydrocyclone separator for separating a material mixture into two fractions and comprising means forming a separation chamber having an upper portion and a downwardly tapering lower portion and also having a tangential inlet for in-feed of said material to said upper portion, means centrally located with respect to said chamber forming a first outlet from said upper portion for one of said fractions, said lower portion of the chamber tapering to a second outlet for the other of said fractions, said chamber-forming means including imperforate cylindrical wall means surrounding said upper chamber portion and imperforate conical wall means surrounding said lower chamber portion, and means for detecting leakage from the separation chamber through said wall means including an outer shell surrounding only a single said chamber-forming means and defining therewith at least one compartment surrounding both said cylindrical and said conical wall means, said compartment being closed from said inlet and from said first and second outlets of the separation chamber, the detecting means also including means for maintaining said compartment at a lower pressure than that at the outer periphery of the separation chamber when the separator is in operation, whereby said compartment can receive leakage from both said upper and said lower portions of the separation chamber.

2. The separator of claim 1, comprising also means dividing said compartment into sub-compartments surrounding said cylindrical and said conical wall means.

3. The separator of claim 2, wherein said wall means include at least two sections having an interconnection which forms an outwardly extending rib, said shell having an internal flange on which said rib rests, said flange and rib forming said dividing means.

4. The separator of claim 1, in which said outer shell surrounds said single chamber-forming means in substantially concentric closely spaced relation thereto.

5. The separator of claim 1, in which said detecting means also includes a transparent portion of said shell, whereby said leakage can be detected visually.

6. The separator of claim 1, in which said detecting means also includes means for sensing the presence of said leakage in said compartment.

7. The separator of claim 1, in which each said compartment has a restricted discharge opening.

* * * * *